US006688282B1

(12) United States Patent
Okubo et al.

(10) Patent No.: US 6,688,282 B1
(45) Date of Patent: Feb. 10, 2004

(54) POWER-BASED IDLE SPEED CONTROL

(75) Inventors: Carol Louise Okubo, Belleville, MI (US); David Karl Bidner, Livonia, MI (US); Jeffrey Allen Doering, Canton, MI (US); John Ottavio Michelini, Sterling Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 35 days.

(21) Appl. No.: 10/064,909

(22) Filed: Aug. 28, 2002

(51) Int. Cl.[7] ..... F02D 41/16; F02D 41/00

(52) U.S. Cl. ..... 123/339.11; 123/334; 123/339.14; 701/110

(58) Field of Search ..... 123/339.11, 339.1, 123/339.14, 339.16, 339.19, 334, 335, 681, 350; 701/103, 110

(56) References Cited

U.S. PATENT DOCUMENTS 5,375,574 A 12/1994 Tomisawa et al.
5,463,993 A 11/1995 Livshits et al.
5,479,898 A * 1/1996 Cullen et al. ..... 123/350
5,495,835 A 3/1996 Ueda
5,662,084 A 9/1997 Deguchi et al.
5,692,471 A * 12/1997 Zhang ..... 123/350
5,697,337 A 12/1997 Takahashi et al.
6,098,592 A * 8/2000 Hess et al. ..... 123/350
6,109,236 A 8/2000 Takahashi et al.
6,119,654 A 9/2000 Heiselbetz et al.

* cited by examiner

*Primary Examiner*—Henry C. Yuen
*Assistant Examiner*—Arnold Castro
(74) *Attorney, Agent, or Firm*—Diana D. Brehob

(57) ABSTRACT

A system and method are disclosed for regulating engine idle speed by coordinating control of two actuators: a slow actuator and a fast actuator. The slow actuator is preferably a throttle valve and the fast actuator is preferably an ignition system affecting spark timing. The slow actuator is controlled based on an idle power requirement and the target idle speed; whereas the fast actuator is controlled based on the idle power requirement and the actual idle speed. Additionally, control of the two actuators is further based on a desired power reserve and an actual power reserve. Power reserve is related to the ratio of the power produced by the engine and the power that would be produced by the engine if the faster actuator were at its optimal setting.

27 Claims, 5 Drawing Sheets

POWER-BASED IDLE SPEED CONTROL

BACKGROUND OF INVENTION

1. Field of the Invention

The invention relates to a method and system for regulating engine idle speed of an internal combustion engine equipped with an electronic throttle.

2. Background of the Invention

In engines equipped with electronic throttles, airflow to the engine is controlled based on demanded engine torque, which is determined from accelerator pedal position. This torque-based type of control is suitable for operating conditions for which the operator is demanding a non-negligible torque. However, at idle, in which the driver is demanding no torque to be delivered to the wheels of the vehicle, the desire is to maintain a constant engine speed. Commonly, airflow is feedback, controlled to provide a desired constant engine speed during idle. The inventors of the present invention have recognized a problem in combining control based on airflow at idle and torque based control at higher torque conditions. Specifically, the inventors have recognized that engine speed my deviate from the desired value due to a torque bump when traversing between the two engine control modes.

Additionally, the inventors have recognized airflow-based control at idle leads to degraded control over engine speed during a transition in operating mode of a variable displacement engine. A variable displacement engine is one in which some of the engine cylinders are deactivated at low torque causing the engine to deliver higher fuel economy than using all engine cylinders to deliver the desired torque. The problem is in maintaining constant idle speed when a transition in the number of activated cylinders occurs.

The inventors of the present invention have controlled two actuators, e.g., spark and throttle, controlling both based on a single idle torque. Idle speed control was degraded using this method because the two actuators operating on the same request to alter idle torque interfere with each other thereby failing to provide sufficient engine speed regulation.

SUMMARY OF INVENTION

The present invention addresses shortcomings discussed above by providing a method and system for regulating idle speed based on a power requirement.

Under the invention, a method for regulating idle speed of an engine includes determining a target engine idle speed based on an engine operating condition; determining a power requirement based on the target engine idle speed; determining actual engine speed; controlling a first engine actuator (e.g., a slower actuator) based on the power requirement and the target engine idle speed; and controlling a second engine actuator (e.g., a faster actuator) based on the power requirement and the actual engine speed.

In one embodiment of the invention, the first engine actuator is a slow engine actuator that may require multiple engine cycles to effect a change in engine speed. Because of its relatively slower ability to respond, it is controlled based on the target speed desired. The second engine actuator is a fast engine actuator that is capable of affecting engine by, for example, the next combustion event. Because of its relatively faster ability to respond, the second actuator can respond to situations that make the actual engine speed change. Examples of slow engine actuators include throttle valve actuators and valve timing actuators. Examples of fast engine actuators include ignition actuators and fuel actuators.

The method may further include adjusting the power requirement based on deviation of the actual engine speed from the target engine idle speed to obtain an adjusted power requirement. In addition, the method may include determining a desired power reserve, and adjusting the adjusted power requirement based on the desired power reserve to obtain a first adjusted power requirement. The step of controlling a first engine actuator may then comprise controlling the first engine actuator based on the first adjusted power requirement and the target engine idle speed.

The method may be applied to an engine which is a multi-cylinder, variable displacement engine capable of deactivating one or more of said cylinders. The method may further include controlling the first actuator, preferably a throttle valve, based on the number of deactivated cylinders and controlling the second actuator, preferably a spark advance timing, also based on the number of deactivated cylinders.

The method may further include determining a desired power ratio based on the desired power reserve, determining an actual power ratio based on engine operating conditions, and adjusting the adjusted power requirement based on the difference between the desired power ratio and the actual power ratio to obtain a second adjusted power requirement. Controlling a second engine actuator may then be based on the second adjusted power requirement and the actual engine speed.

Further under the invention, a system for regulating engine idle speed of an engine includes an operating condition sensor for sensing an engine operating condition, and an engine speed sensor for sensing actual engine speed. The system further includes an electronic control unit in electrical communication with the operating condition sensor and the engine speed sensor, and first and second engine actuators in electrical communication with the electronic control unit. The electronic control unit includes instructions for determining a target engine idle speed based on the engine operating condition, instructions for determining a power requirement based on the target engine idle speed, instructions for controlling the first engine actuator based on the power requirement and the target engine idle speed, and instructions for controlling the second engine actuator based on the power requirement and the actual engine speed.

According to the present invention, idle control is based on torques computed for first and second actuators. Since control outside of idle is also based on torque, a transition between idle and non-idle is facilitated by the present invention. The inventors of the present invention have recognized an advantage of the present invention is that a smoother transition is possible between the two operating regimes. Specifically, the transition occurs without incurring a speed deviation or discontinuity, which would be undesirable to the operator of the vehicle.

The present invention also provides smooth transitions among operating modes in a variable displacement engine (VDE) during idle. A VDE disables some of the engine's cylinders when demanded engine torque is low to provide increased fuel economy. A VDE may also operate with some of the cylinders disabled at idle to obtain fuel savings. However, there are situations in which operation of all cylinders may be requested at idle: during cold weather operation to heat the engine and after-treatment system and to provide smooth operation; during performance of an engine diagnostic operation, such as an emission control system evaluation; during carbon canister vapor purge; and others. As a result, a transition between partial and full cylinder operation may occur during idle. The inventors of the present invention have recognized that by regulating engine speed during idle according to the present invention, i.e., based on controlling the first and second actuators on first and second torques, respectively, and further basing the control of the actuators on the number of deactivated cylinders, a transition between partial and full cylinder operation, and vice versa, of the VDE can occur without a speed flare because the idle speed controller is still in control during the transition.

The inventors have also recognized another advantage of the present invention by basing the torque calculation for controlling the first actuator on the desired or target idle speed and basing the torque calculation for controlling the second actuator on the actual idle speed that idle speed regulation is more robust than if both actuators were controlled based on the same torque.

The above advantages, other advantages, and other features of the present invention will be readily apparent from the following detailed description of the preferred embodiments when taken in connection with the accompanying drawings.

BRIEF DESCRIPTION OF DRAWINGS

The advantages described herein will be more fully understood by reading an example of an embodiment in which the invention is used to advantage, referred to herein as the Detailed Description, with reference to the drawings wherein.

DETAILED DESCRIPTION

Figure 1:
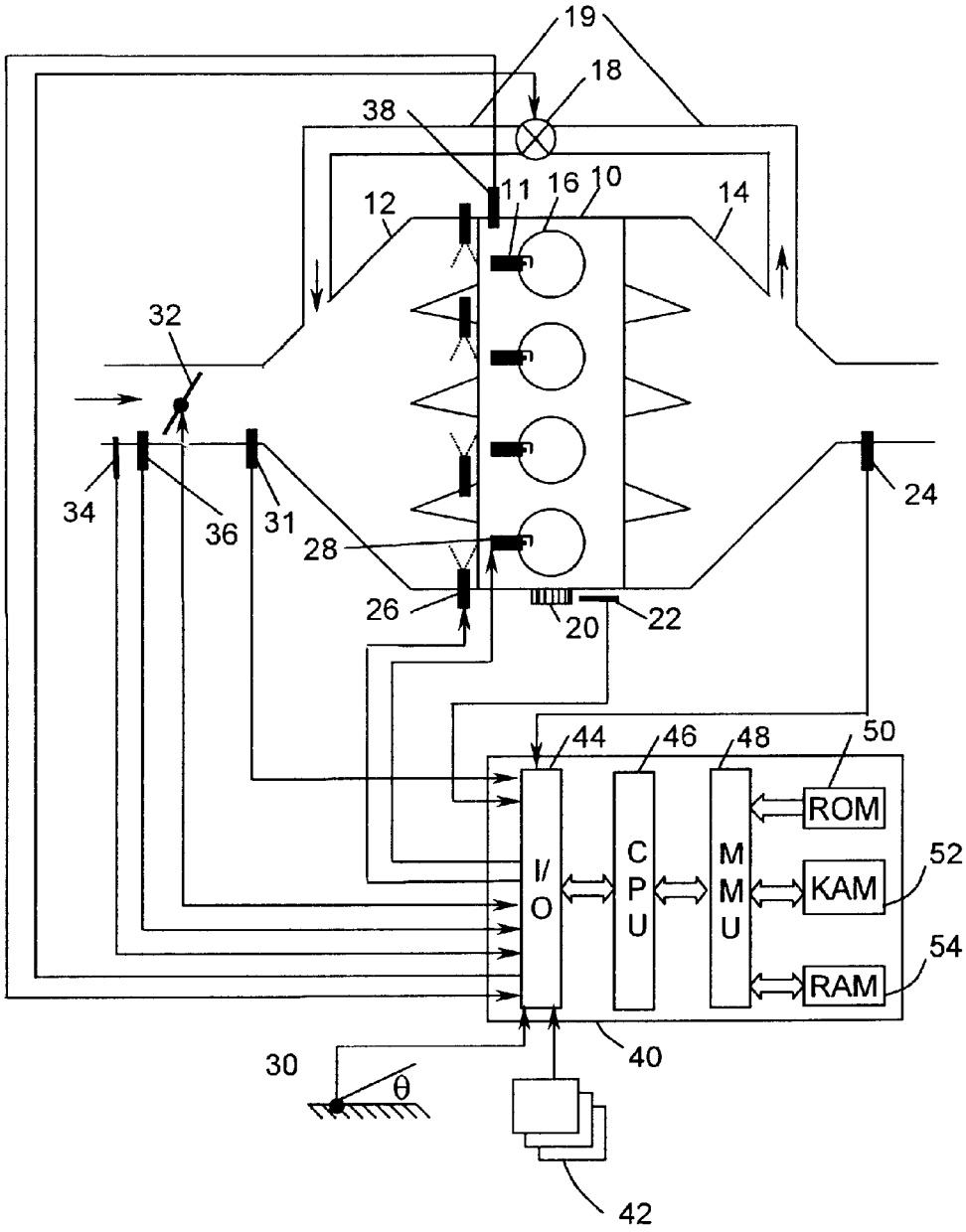
FIG. 1 is a schematic diagram of a system according to the invention for regulating engine idle speed of an engine.

FIG. 1 shows an internal combustion engine 10 with an intake system 12 in which a throttle valve 32 is disposed. By way of example, engine 10 has four cylinders 16 in which spark plugs 11 are disposed. Cylinders 16 are supplied fuel by injectors 26. Engine 10 is equipped with an exhaust gas recirculation system (EGR) 19 which connects the exhaust 14 system with the intake system 12 via an EGR valve 18. The engine is coupled to a toothed disk 20. A sensor 22 detects the teeth of disk 20, whereby engine speed can be computed in the engine controller.

Continuing to refer to FIG. 1, electronic control unit (ECU) 40 is provided to control engine 10. ECU 40 has a microprocessor 46, called a central processing unit (CPU), in communication with memory management unit (MMU) 48. MMU 48 controls the movement of data among the various computer readable storage media and communicates data to and from CPU 46. The computer readable storage media preferably include volatile and nonvolatile storage in read-only memory (ROM) 50, random-access memory (RAM) 54, and keep-alive memory (KAM) 52, for example. KAM 52 may be used to store various operating variables while CPU 46 is powered down. The computer-readable storage media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by CPU 46 in controlling the engine or vehicle into which the engine is mounted. The computer-readable storage media may also include floppy disks, CD-ROMs, hard disks, and the like. CPU 46 communicates with various sensors and actuators via an input/output (I/O) interface 44. Examples of items that are actuated under control by CPU 46, through I/O interface 44, are fuel injection timing, fuel injection rate, fuel injection duration, throttle valve 32 position, spark plug 11 timing, EGR valve 18 position. Various other sensors 42 and specific sensors (engine speed sensor 22, pedal position sensor 30, manifold absolute pressure sensor 31, exhaust gas component sensor 24, air temperature sensor 34, and mass airflow sensor 36, engine coolant sensor 38) communicate input through I/O interface 44 and indicate such things as engine rotational speed, vehicle speed, coolant temperature, manifold pressure, pedal position, throttle valve position, air temperature, exhaust stoichiometry, exhaust component concentration, and air flow. Some ECU 40 architectures do not contain MMU 48. If no MMU 48 is employed, CPU 46 manages data and connects directly to ROM 50, RAM 54, and KAM 52. Of course, the present invention could utilize more than one CPU 46 to provide engine control and ECU 60 may contain multiple ROM 50, RAM 54, and KAM 52 coupled to MMU 48 or CPU 46 depending upon the particular application.

Figure 2:
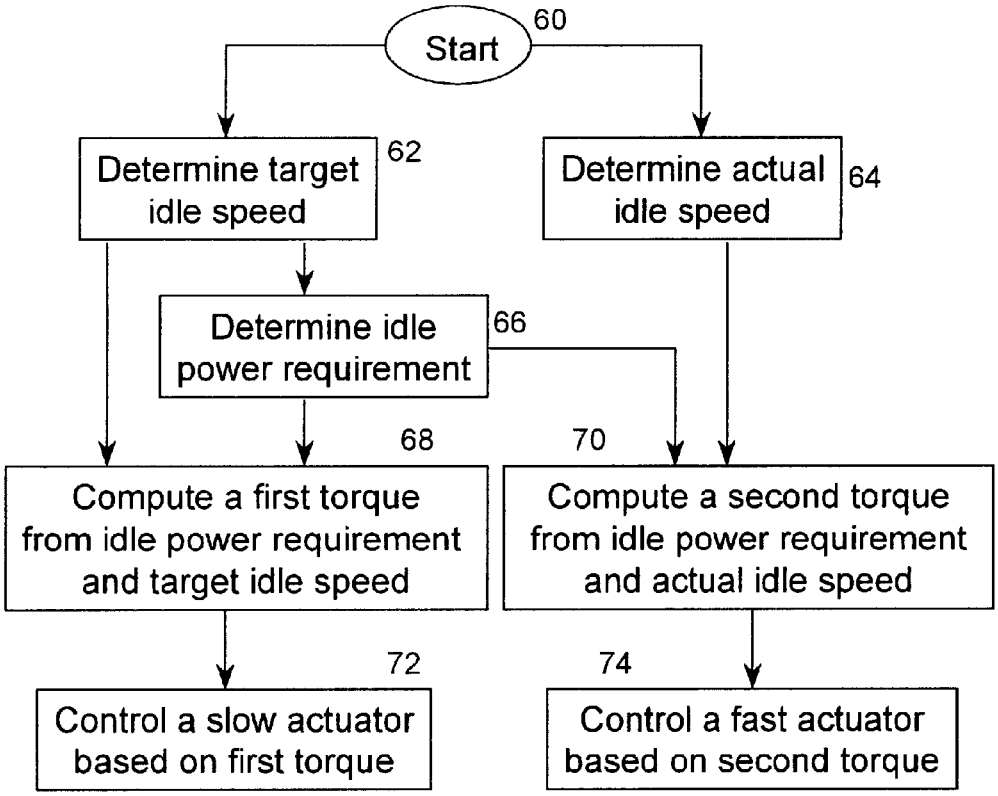
FIG. 2 is a flowchart illustrating operation of a method according to the invention for regulating engine idle speed.

FIG. 2 illustrates a simplified version of an embodiment of the present invention. The routine starts in step 60. From step 60, both steps 62 (determining the target idle speed) and 64 (determining the actual idle speed) are accomplished, in any order. Based on the target idle speed, the idle power requirement can be determined, step 66. Based on the well known relationship, $$\text{Power}=2*\pi*\text{Torque}*\text{Speed},$$

two torques are computed. In step 68, a first torque is computed based on the idle power requirement, as determined in step 66, and the target idle speed, as determined in step 62:

$$\text{Torque}_1=\text{Power}/(2*\pi*\text{Speed}_{target}).$$

A second torque is determined, in step 70, based on idle power requirement (from step 66) and the actual idle speed, as determined in step 64:

$$\text{Torque}_2=\text{Power}/(2*\pi*\text{Speed}_{actual}).$$

The first torque is used to control a slow actuator, step 72; and the second torque is used to control a fast actuator, step 74. The routine of FIG. 2 continues during idle and an alternative control scheme, which is not a part of the present invention, is accessed when the driver demand is for positive output torque.

The first engine actuator is a slow engine actuator that requires multiple engine cycles, e.g., three to ten engine revolutions, to change engine speed. Examples of slow engine actuators include throttle valve 32 and valve actuators (not shown), such as variable cam timing actuators and variable valve lift actuators which are hydraulically actuated. Throttle valve 32 has a large range of authority allowing it to address sustained increases in demanded torque.

The second engine actuator is a fast actuator, which can cause a change in torque produced by the engine, and thus engine speed, within one revolution of the engine. The second actuator is, typically, the electronic ignition system, which affects spark timing. Alternatively, the second actuator is a fuel injection system, in which fuel pulse width commanded to the next injector to inject is increased. Neither the electronic ignition system nor the fuel injection system has a wide range of authority to increase engine torque to increase engine speed. Thus, demands for sustained increases in torque should be provided by an actuator with a wide range of authority such as a throttle valve. In another alternative, the fast actuator is a valve actuator, which is capable of adjustment within one engine revolution, such as a solenoid actuated valve system. This fast actuator has a wide range of authority in controlling torque.

Referring to FIG. 2, step 66 in which the idle power requirement is determined can be considered a feed-forward controller in which engine losses are estimated. Engine losses include friction, pumping, and accessory. Frictional losses comprise: piston ring-bore friction, bearing friction, valve train friction, as examples. Pumping losses is the work performed by the engine in pumping fresh charge past the throttle and expelling burned gases through the exhaust system. Accessory losses are due to the oil pump, water pump, air conditioner, power steering pump, alternator, as examples. These losses are estimated based on oil temperature, engine speed, manifold pressure, and other engine parameters known within ECU 40. The load placed on the engine by accessories, such as the alternator and air conditioner, varies as the demand for charging and cooling, respectively, vary. In spite of the variation in the losses, which may change in a stepwise manner, idle speed control is maintained. If the losses are computed in terms of torque, they are converted to power, through the equation above.

The determination of idle power requirement, step 66, can be further broken down into two steps, the first being the estimation of engine losses as described above. Preferably, the idle power requirement, then, is corrected based on a deviation of the actual engine speed from the target engine idle speed.

As mentioned above, the losses incurred by the engine may change stepwise. An example of this is when an air conditioning compressor is activated. The engine torque required to maintain engine speed increases stepwise. For engine 10 to be capable of reacting to a sudden demand for an increase in torque due a sudden change in accessory losses, it is necessary for an actuator to operate at less than its optimal condition. In one example, the spark timing is retarded from its optimal timing. In response to an increase in torque be demanded, spark, a fast actuator, is immediately adjusted toward its optimal timing. In this way, the sudden demand for an increase in torque is satisfied. Following the increase in torque, a slow actuator, e.g., the throttle valve, is opened to provide the increase in torque while spark is simultaneously adjusted to its prior retarded condition so that if a further increase in torque were to be demanded, the capability to do so would be available with a rapid spark timing adjustment. The power reserve is provided by operating the second (fast) actuator at a condition, which provides less than the power that would be developed at its optimal setting. The effectiveness in providing additional power rapidly is ensured by providing the diminution in power by the faster actuator setting because the faster actuator can react rapidly to a call for higher power.

The above-described desire to operate engine 10 at a condition in which there is reserve power is an embodiment of the present invention. The desired power reserve is a value determined in ECU 40. It may be a constant value or based on a lookup table as a function of operating condition. A typical value of desired power reserve is 5%, although it could also be a range.

Figure 3:
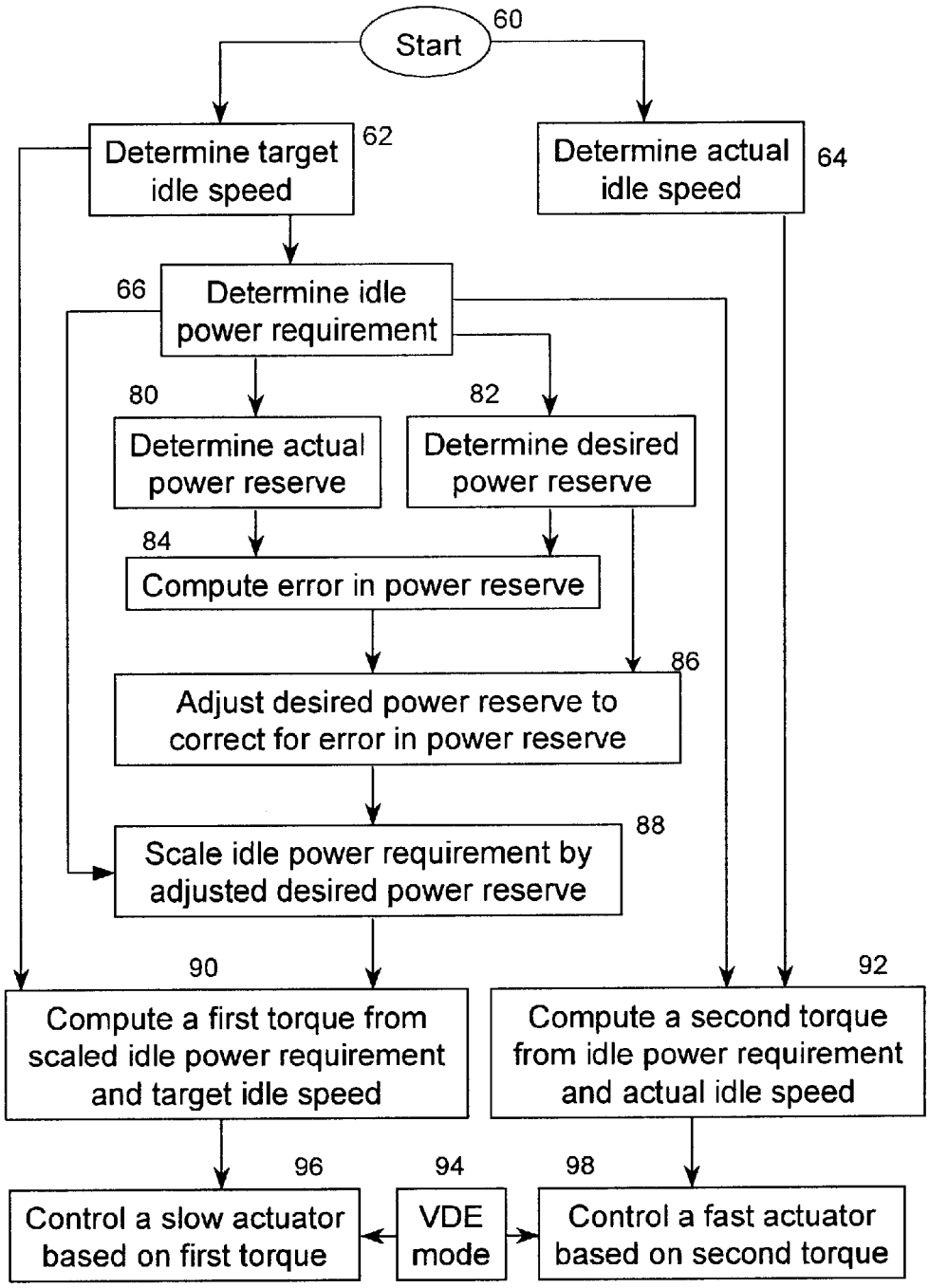
FIG. 3 is a flowchart illustrating operation of a method according to the invention for regulating engine idle speed.

The invention, incorporating the power reserve feature, is shown in FIG. 3. Steps 60, 62, 64, and 66 are identical to FIG. 2 and described in regards to FIG. 2. In steps 80 and 82, the actual and desired power reserves are determined. The actual power reserve is computed from:

$$\text{actual power reserve} = 1 - (\text{actual power}/\text{maximum power})$$

where actual power is the power produced by the engine and maximum power is the power that would be produced if the fast actuator were at its optimal setting. Determining the desired power reserve is outside the scope of the present invention. The desired power reserve may be a constant value or a function of operating conditions. The desired power reserve is determined based on the configuration and particulars of the accessory and other losses of the engine. In step 84, the error between actual (80) and desired (82) power reserves is determined. In step 90, a first torque is determined based on the target idle speed (step 62), the idle power requirement (step 66), and the error in power reserve (step 84). In step 96, the slow actuator is controlled based on first torque from step 90. As discussed above, the slow actuator provides a sustained increase in torque. Thus, the slow actuator is the actuator that attains a position which brings the error in power reserve to zero. In contrast, the second torque computed in step 92, which is used to control the fast actuator in step 98, is based on scaled idle power requirement in step 88, which is based on the desired power reserve.

If engine 10 is a VDE engine, the control of the first and second actuators are further based on information about the VDE mode. Specifically, information about the number of deactivated cylinders is used by the controllers to provide a smooth transition among VDE modes at idle, step 94 of FIG. 3.

Figure 4A:
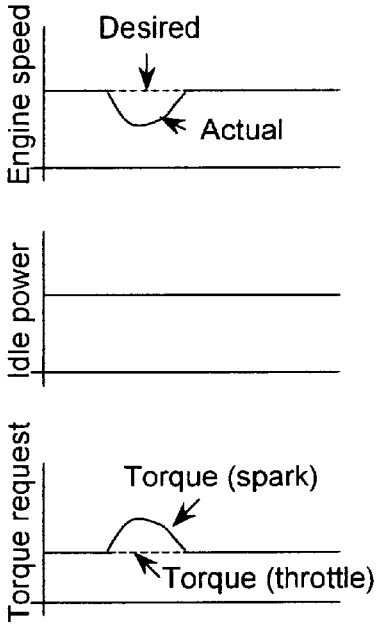
FIGS. 4*a* and 4*b* are graphs illustrating operational aspects of a system according to the invention.
Figure 4B:
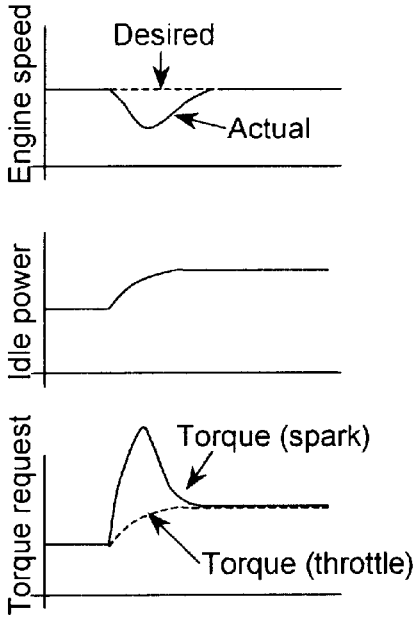

FIGS. 4*a* and 4*b* show operational aspects of a system that includes a throttle valve as a first engine actuator and an ignition system (spark timing) as the second actuator. In FIG. 4*a*, the idle power is constant for the time period shown in the graph. However, an engine speed drop occurs, which could possibly be due to a poor combustion event or a transition in a VDE. The desired engine speed is constant throughout the time period in FIG. 4*a*. Because the first torque, that for controlling the throttle, is based on the desired speed, it remains constant. However, the second torque, that for controlling the spark in the present example, increases in reaction to the actual speed dropping. Refer to equation above, to show that as speed decreases, torque increases, at constant power. The result in the present example is that spark is used to cause actual engine speed to quickly return to desired engine speed. Once actual engine speed returns to desired idle speed, second torque returns to the prior value.

In FIG. 4*b*, a case is shown in which the idle power requirement increases over time. This could be in response to a change in alternator load or an air conditioner compressor turning on or other demand for additional power from the engine. Coincidentally, a dip in actual engine speed occurs. Similar to FIG. 4*b*, the second torque (which is commanded to spark) increases due to a drop in actual engine speed. The increase in second torque is more pronounced than in FIG.

4*a* because the idle power requirement has simultaneously increased due to the change in accessory power requirement. In FIG. 4*a*, first torque (that commanded to the throttle valve) does not change. In FIG. 4*b*, however, first torque does increase in response to the increase in idle power requirement. It increases less than second torque (spark torque) because first torque (throttle valve torque) is based on desired engine speed rather than actual engine speed. When desired engine speed is again achieved, second torque decreases, although not to initial value. Thus, in the steady state at the higher idle power requirement, both first torque and second torque are higher. FIG. 4*b* demonstrates how the faster actuator, spark in the present example, reacts to rapid demands for increased torque; whereas, the slower actuator, throttle valve in the present example reacts to a sustained increase in idle power requirement and stays at the higher level.

Figure 5A:
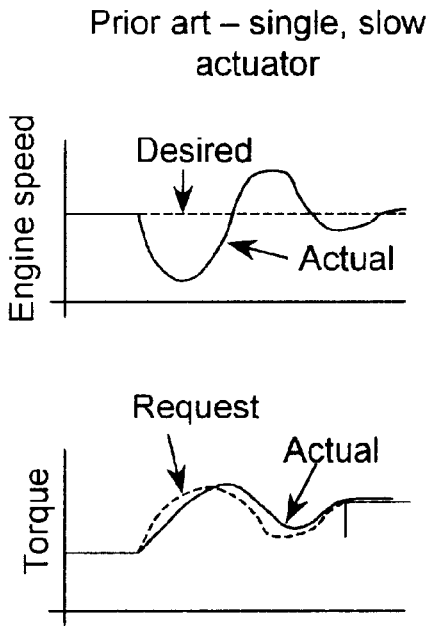
FIGS. 5*a* and 5*b* are graphs illustrating operational aspects of prior art systems.
Figure 5B:
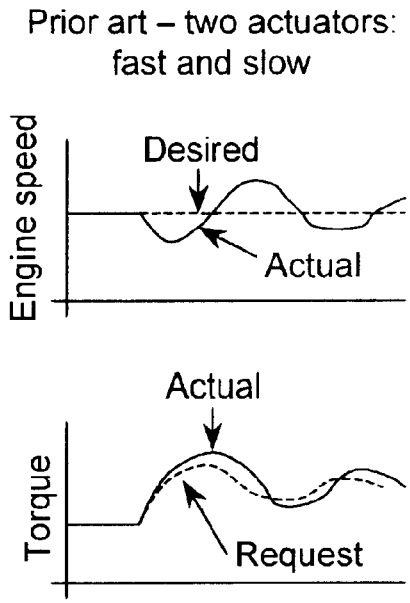

FIGS. 5*a* and 5*b* illustrate the problems of prior art methods in more detail. Both FIGS. 5*a* and 5*b* relate to the situation of FIG. 4*b*, in which a drop in engine speed occurs due to a change in accessory power requirement. FIG. 5*a* indicates the result if only a slow actuator, preferably the throttle valve, is actuated to maintain idle speed. The difference in the actual and desired idle speeds is used to communicate a torque request to the slow actuator. Because it is a slow actuator, the actual torque lags that requested torque. Due to the lag, the engine idle speed drops farther than the other examples which also use a faster actuator. Also, because of the lag, the idle speed overshoots. The idle speed oscillates a few times before attaining the desired idle speed again. FIG. 5*b* indicates the situation in which both slow and fast actuators are employed and both actuators are supplied the same control signal. Because a faster actuator, preferably spark, is used, the engine speed does not drop so low before the system reacts and causes idle speed to rise. However, because both actuators are trying to achieve the same goal of increasing spark and the torque response of the two actuators is at a different rate, the actual torque oscillates at a greater amplitude than requested torque and oscillates for a longer period of time. Referring once again to FIG. 4*b*, an advantage of the present invention is that the two actuators are coordinated, thereby providing a quick recovery from a drop in engine speed with reduced subsequent oscillations.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

We claim:

1. A method for controlling an engine during idle to attain a target engine idle speed, the engine being coupled to a first actuator and a second actuator, the method comprising:

determining an actual engine speed;

determining an idle power requirement based on the target engine idle speed;

computing a first torque based on said idle power requirement and the target engine idle speed;

computing a second torque based on said idle power requirement and said actual engine speed;

controlling the first actuator based on said first torque; and controlling the second actuator based on said second torque.

2. The method of claim 1, further comprising the step of correcting said idle power requirement based on a deviation of said actual engine speed from the target idle speed.

3. The method of claim 1, further comprising the steps of:

determining a desired power reserve;

determining an actual power reserve;

computing a first torque based on said idle power requirement, said target engine idle speed and a deviation in said desired power reserve and said actual power reserve; and computing a second torque based on said idle power requirement, said actual engine speed and said desired power reserve.

4. The method of claim 3, further comprising the steps of:

controlling the first actuator based on said first torque; and controlling the second actuator based on said second torque.

5. The method of claim 1 wherein the first actuator affects engine torque more slowly than the second actuator.

6. The method of claim 1 wherein a change in engine torque as a result of actuating said first actuator occurs in three or more engine revolutions.

7. The method of claim 1 wherein a change in engine torque as a result of actuating said second actuator occurs in less than two engine revolutions.

8. The method of claim 1 wherein said first actuator is a throttle valve.

9. The method of claim 1 wherein said second actuator is an ignition system controlling the time of spark plug firing.

10. The method of claim 1 wherein said first actuator is a hydraulically actuated variable valve timing device.

11. The method of claim 1 wherein said second actuator is a fuel injector.

12. The method of claim 1 wherein said second actuator is a solenoid actuated variable valve timing device.

13. A method for controlling an engine during idle, comprising the steps of:

determining a target engine idle speed;

determining an actual engine speed;

determining an idle power requirement based on the target engine idle speed;

computing a first torque based on said idle power requirement and said target engine idle speed; and computing a second torque based on said idle power requirement and said actual engine speed;

adjusting a position of said throttle valve based on said first torque; and adjusting a timing at which said spark plug fires based on said second torque.

14. The method of claim 13, further comprising the step of correcting said idle power requirement based on a deviation of said actual engine speed from the target idle speed.

15. The method of claim 13, further comprising the steps of:

determining a desired power reserve;

determining an actual power reserve;

computing a first torque based on said idle power requirement, said target engine idle speed and a deviation in said desired power reserve and said actual power reserve; and computing a second torque based on said idle power requirement, said actual engine speed and said desired power reserve.

16. The method of claim 15 wherein the engine has a throttle valve disposed in an intake and a spark plug disposed in an engine cylinder, further comprising the steps of:

adjusting a position of said throttle valve based on said first torque; and adjusting a timing at which said spark plug fires based on said second torque.

17. The method of claim 16, wherein the engine is a variable displacement engine having a multiplicity of cylinders and has the capability to deactivate one or more of said cylinders, further comprising the steps of:

basing said adjustment of said position of said throttle valve on a number of deactivated cylinders; and basing said adjustment of said timing of said spark plug firing on a number of deactivated cylinders.

18. A system for regulating idle speed of an internal combustion engine to a target idle speed, comprising:

a first actuator coupled to the engine, said first engine actuator affects engine torque;

a second actuator coupled to the engine, said second engine actuator affects engine torque; and an electronic control unit coupled to the engine and said first and second actuators, said electronic control unit determining: an actual engine speed, an idle power requirement based on the target engine idle speed and said actual engine speed, a first torque based on said idle power requirement and the target engine idle speed, and a second torque based on said idle power requirement and said actual engine speed, said electronic control unit further commanding an adjustment of said first actuator based on said first torque and an adjustment of said second actuator based on said second torque.

19. The system of claim 18 wherein said first actuator is a throttle valve disposed in an intake of the engine.

20. The system of claim 18 wherein said second actuator is an electronic ignition system which controls a time of firing of spark plugs, said spark plugs are disposed in engine cylinders.

21. The system of claim 20 wherein the engine is a variable displacement engine having a multiplicity of cylinders and has the capability to deactivate one of more of said cylinders, and said step of commanding adjustments in said first and second actuators is further based on a number of deactivated cylinders.

22. A computer readable storage medium having stored data representing instructions executable by a computer to regulate engine idle speed in an internal combustion engine to a target idle speed, wherein the engine is coupled to first and second actuators which when adjusted affect engine torque, comprising:

instructions to determine an actual engine speed;

instructions to determine an idle power requirement based on the target idle speed;

instructions to control the first actuator based on said idle power requirement and the target idle speed; and instructions to control the second actuator based on said idle power requirement and the actual engine speed.

23. The media of claim 22, further comprising: instructions to determine a desired power reserve; and instructions to determine an actual power reserve.

24. The media of claim 23 wherein said instructions to control the second actuator are further based on said desired power reserve and said instructions to control the first actuator are further based on said desired power reserve and said desired power reserve.

25. The media of claim 22 wherein effects on engine torque as a result of adjusting the first actuator are complete in more than three engine revolutions.

26. The media of claim 22 wherein effects on engine torque as a result of adjusting the second actuator are complete in less than one engine revolution.

27. The media of claim 22 wherein the engine is a multi-cylinder, variable displacement engine having the capability of deactivating some engine cylinders and said instructions to control the first actuator and said instructions to control the second actuator are further based on a number of deactivated cylinders.

* * * * *